United States Patent [19]

Yuyama et al.

[11] Patent Number: 4,727,054

[45] Date of Patent: Feb. 23, 1988

[54] THERMOSENSITIVE RECORDING MATERIAL

[75] Inventors: Yukihiro Yuyama; Takanori Motosugi; Yasuhiro Honda, all of Numazu, Japan

[73] Assignee: Ricoh Company, Ltd., Tokyo, Japan

[21] Appl. No.: 800,032

[22] Filed: Nov. 20, 1985

[30] Foreign Application Priority Data

Nov. 20, 1984 [JP] Japan ..... 59-245385

[51] Int. Cl.[4] ..... B41M 5/22

[52] U.S. Cl. ..... 503/200; 427/152; 503/214; 503/226

[58] Field of Search ..... 346/200, 226; 427/152; 503/200, 214, 216, 217, 226

[56] References Cited

U.S. PATENT DOCUMENTS 4,370,370 1/1983 Iwata et al. ..... 428/202
4,513,301 4/1985 Takayama et al. ..... 346/200

FOREIGN PATENT DOCUMENTS 0146794 11/1981 Japan ..... 346/200
0053484 3/1983 Japan ..... 346/200
0203092 11/1983 Japan ..... 346/200

*Primary Examiner*—Bruce H. Hess
*Attorney, Agent, or Firm*—Oblon, Fisher, Spivak, McClelland & Maier

[57] ABSTRACT

A thermosensitive recording material comprising (a) a support material, (b) an undercoat layer formed thereon, comprising a polyvinyl alcohol having a saponification ratio ranging from 80 mole % to 95 mole %, which serves as water-soluble binder agent, a first water-resisting-property-improvement agent and a first organic filler, (c) a thermosensitive coloring layer formed on the undercoat layer, comprising a leuco dye, a color developer capable of inducing color formation in the leuco dye upon application of heat thereto and the same polyvinyl alcohol as first mentioned and (d) an overcoating layer formed on the thermosensitive coloring layer, comprising the same polyvinyl alcohol as first mentioned, a second water-resisting-property-improvement agent and a second organic filler.

8 Claims, No Drawings

THERMOSENSITIVE RECORDING MATERIAL

BACKGROUND OF THE INVENTION

The present invention relates to a thermosensitive recording material and more particularly to a thermosensitive recording material using a leuco dye as coloring material, which is particularly improved with respect to thermal head matching properties, color developing capability, water resistance, oil resistance and stability of the developed image.

Recently thermosensitive recording materials are employed in a variety of fields, for instance, for use with printers of computers, recorders of medical analytical instruments, facsimile apparatus, automatic ticket vending apparatus, and thermosensitive copying apparatus, since they have the following advantages over other conventional recording materials: (1) Images can be formed by simple heat application, without complicated steps for development; (2) the thermosensitive recording materials can be produced by a simple apparatus and the storage of the thermosensitive recording materials is simple and does not involve excessive costs; (3) as the support material of the thermosensitive recording materials, paper is usually used, which is rather inexpensive in comparison with other support materials, such as synthetic resin films, and when paper is used as the support material, the thermosensitive recording material has a pleasing plain-paper-like touch.

A conventional thermosensitive recording material comprises a support material such as a sheet of paper and a thermosensitive coloring layer formed on the support material, on which thermosensitive coloring layer colored images can be formed by application of heat thereto. For heat application for image formation, a thermal head is in general use. In such a conventional thermosensitive recording material, there are usually employed in the thermosensitive coloring layer a colorless or light-colored leuco dye containing a lactone ring, a lactam ring or a spiropyran ring, and a color developer which induces color formation in the leuco dye upon application of heat by the reaction with the leuco dye, since it is capable of yielding clear images with minimized fogging.

Images that can be obtained by a thermal reaction of a leuco dye serving as coloring material and a phenolic or other organic acidic material serving as a color developer capable of inducing color formation in the leuco dye have the shortcoming that they are apt to discolor when coming into contact with a plasticizer contained in wrapping films, plastic materials and rubber eraser, a cooking oil, water, organic solvents and alcohol.

In order to eliminate this shortcoming, there is proposed a method of overcoating the thermosensitive coloring layer with a water-soluble binder agent. However, the thermosensitive coloring sensitivity of the recording material is significantly reduced by such overcoating. Furthermore, such overcoating can reduce the water resistance, image stability and thermal head matching properties of the recording material.

SUMMARY OF THE INVENTION

It is therefore an object of the present invention to provide a thermosensitive recording material having high thermal coloring sensitivity and excellent thermal head matching properties, with the developed images having high water resistance and excellent image stability.

According to the present invention, the above object is achieved by a thermosensitive recording material comprising (a) a support material, (b) an undercoat layer formed thereon comprising a polyvinyl alcohol having a saponification ratio ranging from 80 mole % to 95 mole %, which serves as water-soluble binder agent, a first water-resisting-property-improvement agent and a first organic filler, (c) a thermosensitive coloring layer formed on the undercoat layer, comprising a leuco dye, a color developer capable of inducing color formation in the leuco dye upon application of heat thereto and the same polyvinyl alcohol as mentioned above and (d) an overcoating layer formed on the thermosensitive coloring layer, comprising the same polyvinyl alcohol as mentioned above, a second water-resisting-property-improvement agent and a second organic filler.

DETAILED DESCRIPTION OF THE PREFERRED EMBODIMENTS

In the thermosensitive recording material according to the present invention, the overcoating layer serves to improve the resistance of the thermosensitive recording material to chemicals, but slightly decreases the coloring sensitivity of the thermosensitive coloring layer.

However, the undercoat layer comprising a first organic filler having a low thermal conductivity, a polyvinyl alcohol having a saponification ratio ranging from 80 mole % to 95 mole % and a first water-resisting-property improvement agent is capable of making up for such decrease in the coloring sensitivity of the thermosensitive coloring layer. Furthermore, the undercoat layer serves to improve the water resistance and thermal head matching properties of the recording material by the above mentioned polyvinyl alcohol serving as water-soluble binder agent and the first water-resisting-property-improvement agent contained therein.

In the present invention, the overcoat layer also contains the same polyvinyl alcohol as mentioned above, a second water-resisting-property-improvement agent and a second organic filler.

In the present invention, it is preferable to employ the above mentioned polyvinyl alcohol having a saponification ratio ranging from 80 mole % to 95 mole % for achieving high image stability and high image quality As the above mentioned first and second water-resisting-property-improvement agents, for example, formaldehyde, glyoxal, chromium alum, melamine, melamine-formaldehyde resin, polyamide resin and polyamide-epichlohydrin resin can be employed.

As the first and second organic fillers employed in the undercoat layer and the overcoat layer, for example, urea-formaldehyde resin, styrene - methacrylic acid copolymer, polystyrene resin, phenolic resin, polycarbonate resin and polypropylene resin can be employed.

In the undercoat layer, it is preferable that the first organic filler be contained in an amount ranging from 1 to 5 g/m$^2$, more preferably in an amount ranging from 3 to 5 g/m$^2$, with respect to the support material, the amount of the polyvinyl alcohol be in the range of from 0.01 to 5 parts by weight, more preferably in the range of from 0.5 to 1 part by weight, to 1 part by weight of the first organic filler, and the amount of the first water-resisting-property-improvement agent be in the range of from 0.05 to 0.6 parts by weight, more preferably in the range of from 0.1 to 0.4 parts by weight, to 1 part by weight of the polyvinyl alcohol.

In the thermosensitive coloring layer, it is preferable that the polyvinyl alcohol be contained in an amount ranging from 0.02 to 0.2 parts by weight, more preferably in an amount ranging from 0.05 to 0.15 parts by weight, to 1 part by weight of a leuco dye.

In the overcoat layer, it is preferable that the polyvinyl alcohol be contained in an amount ranging from 1 to 5 g/m$^2$, more preferably in the range of from 2 to 3 g/m$^2$, with respect to the support material, the amount of the second organic filler be in the range of from 0.1 to 0.8 parts by weight, more preferably in the range of from 0.2 to 0.6 part by weight, to 1 part by weight of the polyvinyl alcohol, and the amount of the second water-resisting-property-improvement agent be in the range of from 0.1 to 0.7 parts by weight, more preferably in the range of from 0.3 to 0.5 parts by weight, to 1 part by weight of the polyvinyl alcohol.

As the leuco dyes for use in the thermosensitive coloring layer in the present invention, conventional leuco dyes can be employed. Examples of such leuco dyes are triphenyl-methane-type leuco compounds, fluoran-type leuco compounds, phenothiazine-type leuco compounds, auramine-type leuco compounds, spiropyran-type leuco compounds and indolino-phthalide-type leuco compounds.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-dimethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthylamino-4'-bromofluoran,
3,6-dimethoxyfluoran,
3-diethylamino-6-methyl-7-mesidino-4',5'-benzofluoran,
3-(p-dimethylaminophenyl)-3-phenylphthalide,
3-di(l-ethyl-2-methylindole)-3-yl-phthalide,
3-diethylamino-6-phenyl-7-azafluoran,
3,3-bis(p-diethylaminophenyl)-6-dimethylaminophthalide,
2-bis(p-dimethylaminophenyl)methyl-5-dimethylaminobenzoic acid,
3-(p-dimethylaminophenyl)-3-(p-dibenzylaminophenyl) phthalide, and
3-(N-ethyl-N-n-amyl)amino-6-methyl-7-anilinofluoran.

The above leuco dyes can be used alone or in combination.

As the color developers for the above leuco dyes, a variety of electron accepting materials capable of inducing color formation in the above leuco dyes upon application of heat thereto, for example, phenolic and other organic acidic materials, inorganic acidic materials, esters and salts thereof, can be employed.

Specific examples of such color developers are as follows:

gallic acid,
salicylic acid,
3-isophenyl salicylic acid,
3-cyclohexyl salicylic acid,
3,5-di-tert-butyl salicylic acid,
3,5-di-α-methylbenzyl salicylic acid,
4,4'-isoproylidenediphenol,
4,4'-isoproylidenebis(2-chlorophenol),
4,4'-isoproylidenebis(2,6-dibromophenol),
4,4'-isoproylidenebis(2,6-dichlorophenol),
4,4'-isoproylidenebis(2-methylphenol),
4,4'-isoproylidenebis(2,6-dimethylphenol),
4,4'-isoproylidenebis(2-tert-butylphenol),
4,4'-sec-butylidenediphenol,
4,4'-cyclohexylidenebisphenol,
4,4'-cyclohexylidenebis(2-methylphenol),
4-tert-butylphenol,
4-phenylphenol,
4-hydroxydiphenoxide,
α-naphthol,
β-naphthol,
3,5-xylenol,
thymol,
methyl-4-hydroxybenzoate,
4-hydroxyacetophenone,
novolak-type phenolic resin,
2,2'-thiobis(4,6-dichlorophenol),
catechol, resorcinol,
hydroquinone,
pyrogallol,
phloroglucine,
phlorogluocinocarboxylic acid,
4-tert-octylcatechol,
2,2'-methylenebis(4-chlorophenol),
2,2'-methylenebis(4-methyl-6-tert-butylphenol),
2,2'-dihydroxydiphenyl,
ethyl p-hydroxybenzoate,
propyl p-hydroxybenzoate,
butyl p-hydroxybenzoate,
benzyl p-hydroxybenzoate,
p-chlorobenzyl p-hydroxybenzoate,
o-chlorobenzyl p-hydroxybenzoate,
p-methylbenzyl p-hydroxybenzoate,
n-octyl p-hydroxybenzoate,
zinc salicylate,
1-hydroxy-2-naphthoic acid,
2-hydroxy-6-naphthoic acid,
zinc 2-hydroxy-6-naphthoate,
4-hydroxydiphenylsulfone,
4-hydroxy-4'-chlorodiphenylsulfone,
bis(4-hydroxyphenyl)sulfide,
2-hydroxy-p-toluic acid,
zinc 3,5-di-tert-butylsalicylate,
tin 3,5-di-tert-butylsalicyate,
tartaric acid,
oxalic acid,
maleic acid,
citric acid,
succinic acid,
stearic acid,
4-hydroxyphthalic acid,
boric acid,
thiourea derivatives and
4-hydroxythiophenol derivatives.

By referring to the following example, the present invention will now be explained in detail:

EXAMPLE 1

(1) Preparation of Undercoat Layer Formation Liquid and Formation of Undercoat Layer An undercoat layer formation liquid was prepared by dispersing a dispersion A consisting of the following components in a ball mill until the particle size of the solid components became about 3 m.

Dispersion A

| | Parts by Weight |
|---|---|
| 10% aqueous solution of polyvinyl alcohol (saponification ratio: 88 mole %) | 100 |
| Polystyrene (organic filler) | 100 |
| Polyamide-epichlohydrin resin (water-resisting-property-improvement agent) | 1 |
| Water | 200 |

The thus prepared undercoat layer formation liquid was coated on a sheet of commercially available high quality paper (having a basis weight of 50 g/m$^2$) with a deposition of 3.5 g/cm$^2$ when dried, so that an undercoat layer was formed on the high quality paper.

(2) Preparation of Thermosensitive Coloring Layer Formation Liquid and Formation of Thermosensitive Coloring layer Layer Dispersions B and C were prepared by dispersing the following components of each dispersion in a ball mill until the particle size of each solid component became about 3 m.

Dispersion B

| | Parts by Weight |
|---|---|
| 3-(N—methyl-N—cyclohexyl)amino-6-methyl-7-anilinofluoran | 150 |
| 10% aqueous solution of polyvinyl alcohol (saponification ratio: 88 mole %) | 50 |
| Water | 200 |

Dispersion C

| | Parts by Weight |
|---|---|
| Bisphenol A | 150 |
| 10% aqueous solution of polyvinyl alcohol (saponification ratio: 88 mole %) | 50 |
| Stearamide | 100 |

10 parts by weight of Dispersion B and 30 parts by weight of Dispersion C were mixed well, so that a thermosensitive coloring layer formation liquid was prepared.

The thus prepared thermosensitive coloring layer formation liquid was coated on the previously formed undercoat layer with a deposition of 5.0 g/cm$^2$ when dried, so that a thermosensitive coloring layer was formed on the undercoat layer.

(3) Preparation of Overcoat Layer Formation Liquid and Formation of Overcoat Layer An overcoat layer formation liquid was prepared by dispersing a dispersion D consisting of the following components in a ball mill until the particle size of the solid components became about 3 m.

Dispersion D

| | Parts by Weight |
|---|---|
| 10% aqueous solution of polyvinyl alcohol (saponification ratio: 88 mole %) | 100 |
| Thermosetting organic filler | 4 |
| Polyamide-epichlohydrin resin (water-resisiting-property-improvement agent) | 3 |
| Water | 100 |

The thus prepared overcoat layer formation liquid was coated on the above mentioned thermosensitive coloring layer with a deposition of 3.5 g/cm$^2$ when dried, so that an overcoat layer was formed on the thermosensitive coloring layer, whereby a thermosensitive recording material according to the present invention was prepared.

COMPARATIVE EXAMPLE 1

Example 1 was repeated except that the polyvinyl alcohol having a saponification ratio of 88 mole % employed in each of the dispersions A, B, C and D was replaced by a polyvinyl alcohol having a saponification ratio of 98.5 mole so that a comparative thermosensitive recording material No. 1 was prepared.

COMPARATIVE EXAMPLE 2

Example 1 was repeated except that the water-resisting-property-improvement agent employed in the dispersion A in Example 1 was eliminated, so that a comparative thermosensitive recording material No. 2 was prepared.

COMPARATIVE EXAMPLE 3

Example 1 was repeated except that the polyvinyl alcohol employed in the dispersion A in Example 1 was replaced by an SBR emulsion, so that a comparative thermosensitive recording material No. 3 was prepared

COMPARATIVE EXAMPLE 4

Example 1 was repeated except that the undercoat layer formed in Example 1 was eliminated, so that a comparative thermosensitive recording material No. 4 was prepared.

COMPARATIVE EXAMPLE 5

Example 1 was repeated except that the overcoat layer formed in Example 1 was eliminated, so that a comparative thermosensitive recording material No. 5 was prepared.

The thus prepared thermosensitive recording material according to the present invention and the comparative thermosensitive recording materials No. 1 to No. 3 were subjected to super calendering and thermal printing was performed on each thermosensitive recording material by use of a thermal head built-in facsimile apparatus, so that they were subjected to (1) a thermal color developing capability test (2) a thermal head matching test, (3) a plasticizer resistance test, (4) an oil resistance test and (5) water resistance tests (a) and (b) as mentioned below.

(1) Thermal Color Developing Capability Test

This test was conducted by performing thermal printing on each thermosensitive recording material by use of a thermal head built-in facsimile apparatus with application of 12 volts to the thermal head, followed by measuring the image density of each printed image by a Macbeth densitometer.

(2) Thermal Head Matching Test

In this test, thermal printing was performed on each thermosensitive recording material under the same conditions as in the thermal color developing capability test, provided that the thermal printing was continued for an extended period of time until the length of a printed portion amounted to 20 m on each recording material, so that the presence of a material coming from the surface of the recording material (hereinafter referred to as the dust) which adhered to the thermal head was visually investigated.

(3) Plasticizer Resistance Test

In this test, thermally printed samples of each thermosensitive recording material obtained in the above thermal color developing capability test were each covered with a wrapping film containing a plasticizer and were then allowed to stand at 40° C. with a pressure of 100 g/cm$^2$ applied thereto for 24 hours. The image density of each printed portion was then measured by a Macbeth densitometer.

(4) Oil Resistance Test

In this test, cotton oil was applied to the thermally printed samples of each thermosensitive recording material obtained in the above thermal color developing capability test. These samples were then allowed to stand at 40° C. for 24 hours. The image density of each printed portion was then measured by a Macbeth densitometer.

(5) Water Resistance Tests (a) and (b)

Water resistance test (a):

The thermally printed samples of each thermosensitive recording material obtained in the above thermal color developing capability test were immersed in water at 20° C. for 2 hours. After this water immersion, the image density of each printed portion was measured by a Macbeth densitometer.

Water resistance test (b):

The thermally printed samples of each thermosensitive recording material obtained in the above thermal color developing capability test were immersed in water at 20° C. for 3 hours. After this water immersion, the dissolving of the three layers on the support material was visually inspected.

The results of the above tests are summarized in the following Table 1.

TABLE 1

| | Ex. 1 | Comp. Ex. 1 | Comp. Ex. 2 | Comp. Ex. 3 | Comp. Ex. 4 | Comp. Ex. 5 |
|---|---|---|---|---|---|---|
| Color Developing Capability | 1.24 | 1.24 | 1.23 | 1.25 | 1.01 | 1.29 |
| Oil Resistance | 1.20 | 1.05 | 1.18 | 1.15 | 0.85 | 0.31 |
| Plasticizer Resistance | 1.19 | 1.08 | 1.16 | 1.13 | 0.74 | 0.29 |
| Water Resistance (a) | 1.21 | 1.15 | 1.05 | 1.21 | 0.80 | 0.85 |
| Water Resistance (b) | a | b | c | a | a | c |
| Thermal Head Matching Properties | A | B | B | C | A | C |

(1) Marks a, b and c in the water resistance (b) in the above Table 1 respectively denote as follows:
a: The layers were not dissolved at all.
b: The layers were slightly dissolved.
c: The layers were dissolved or peeled off the support material.
(2) Marks A, B and C in the thermal head matching properties in the above Table 1 respectively denote as follows:
A: No adhesion of the dust to the thermal head
B: Slight adhesion of the dust to the thermal head
C: Thermal printing impossible due to considerable adhesion of the dust to the thermal head

What is claimed is:

1. In a thermosensitive recording material comprising a support material, an undercoat layer formed thereon, a thermosensitive coloring layer formed on said undercoat layer and an overcoat layer formed on said thermosensitive coloring layer, the improvement wherein (a) said undercoat layer comprises:

a polyvinyl alcohol having a saponification ratio ranging from 80 mole % to 95 mole %, which serves as a water-soluble binder agent, a first water-resisting-property-improvement agent, and a first organic filler, (b) said thermosensitive coloring layer comprises:

a leuco dye, a color developer capable of inducing color formation in said leuco dye upon application of heat thereto, and a polyvinyl alcohol having a saponification ratio ranging from 80 mole % to 95 mole %, which serves as a water-soluble binder agent, and (c) said overcoat layer comprises:

a polyvinyl alcohol having a saponification ratio ranging from 80 mole % to 95 mole %, which serves as a water-soluble binder agent, a second water-resisting-property-improvement agent, and a second organic filler.

2. A thermosensitive recording material as claimed in claim 1, wherein said first and second water-resisting-property-improvement agents are each selected from the group consisting of formaldehyde, glyoxal, chromium alum, melamine, melamine-formaldehyde resin, polyamide resin and polyamide-epichlohydrin resin.

3. A thermosensitive recording material as claimed in claim 1, wherein said first and second organic fillers are selected from the group consisting of urea-formaldehyde resin, styrene - methacrylic acid copolymer, polystyrene resin, phenolic resin, polycarbonate resin and polypropylene resin.

4. A thermosensitive recording material as claimed in claim 1, wherein said leuco dye is selected from the group consisting of triphenylmethane-type leuco compounds, fluoran-type leuco compounds, phenothiazine-type leuco compounds, auramine-type leuco compounds, spiropyran-type leuco compounds and indolinophthalide-type leuco compounds.

5. A thermosensitive recording material as claimed in claim 1, wherein said color developer is selected from the group consisting of organic acidic materials, inorganic acidic materials, esters and salts thereof.

6. A thermosensitive recording material as claimed in claim 1, wherein in said undercoat layer, the amount of said first organic filler is in the range of from 1 to 5 $g/m^2$ on said support material, the amount of said polyvinyl alcohol is in the range of from 0.01 to 5 parts by weight to 1 part by weight of said first organic filler, and the amount of said first water-resisting-property-improvement agent is in the range of from 0.05 to 0.6 parts by weight to 1 part by weight of said polyvinyl alcohol.

7. A thermosensitive recording material as claimed in claim 1, wherein in said thermosensitive coloring layer, the amount of said polyvinyl alcohol is in the range of from 0.02 to 0.2 parts by weight to 1 part by weight of said leuco dye.

8. A thermosensitive recording material as claimed in claim 1, wherein in said overcoat layer, the amount of said polyvinyl alcohol is in the range of from 1 to 5 $g/m^2$ on said support material, the amount of said second organic filler is in the range of from 0.1 to 0.8 parts by weight to 1 part by weight of said polyvinyl alcohol, and the amount of said second water-resisting-property-improvement agent is in the range of from 0.1 to 0.7 parts by weight to 1 part by weight of said polyvinyl alcohol.

* * * * *